US006725582B2

(12) United States Patent
Adamic et al.

(10) Patent No.: US 6,725,582 B2
(45) Date of Patent: Apr. 27, 2004

(54) ASSEMBLY FOR FASTENING A GROUND ENGAGING TOOL TO A SUPPORT STRUCTURE

(75) Inventors: Dwight L. Adamic, Edmonton (CA); Dennett Netterville, Edmonton (CA)

(73) Assignee: Quality Steel Foundries Ltd., Edmonton (CA)

( * ) Notice: Subject to any disclaimer, the term of this patent is extended or adjusted under 35 U.S.C. 154(b) by 0 days.

(21) Appl. No.: 10/223,889

(22) Filed: Aug. 19, 2002

(65) Prior Publication Data

US 2003/0037468 A1 Feb. 27, 2003

Related U.S. Application Data

(63) Continuation-in-part of application No. 09/591,764, filed on Jun. 12, 2000, now abandoned.

(51) Int. Cl.[7] ..... E02F 9/28

(52) U.S. Cl. ..... 37/456; 403/DIG. 1; 403/379.5

(58) Field of Search ..... 37/455, 456, 459, 37/460; 403/379.4, 379.5, DIG. 1; 172/753

(56) References Cited

U.S. PATENT DOCUMENTS

| | | | | | |
|---|---|---|---|---|---|
| 2,121,993 | A | | 6/1938 | Stocks | |
| 2,576,225 | A | * | 11/1951 | Hostetter | 37/459 |
| 3,256,622 | A | | 6/1966 | Hostetter | |
| 3,410,010 | A | | 11/1968 | Ratkowski | |
| 3,596,958 | A | * | 8/1971 | Bowerman | 292/201 |
| 4,086,013 | A | * | 4/1978 | Miller | 403/292 |
| 4,244,476 | A | * | 1/1981 | Tang | 211/192 |
| 4,349,232 | A | * | 9/1982 | Braun et al. | 299/109 |
| 4,890,854 | A | * | 1/1990 | Hoover | 280/504 |
| 5,088,214 | A | * | 2/1992 | Jones | 37/450 |
| 5,272,824 | A | | 12/1993 | Cornelius | |
| 5,423,138 | A | | 6/1995 | Livesay et al. | |
| 5,438,774 | A | | 8/1995 | Fletcher et al. | |
| 5,469,648 | A | | 11/1995 | Jones et al. | |
| 5,611,638 | A | * | 3/1997 | Dorr et al. | 403/327 |
| 5,634,285 | A | | 6/1997 | Renski | |
| 5,638,621 | A | | 6/1997 | Keech et al. | |
| 5,666,748 | A | * | 9/1997 | Emrich et al. | 37/453 |
| 5,709,043 | A | | 1/1998 | Jones et al. | |
| 5,743,031 | A | | 4/1998 | Launder et al. | |
| 5,806,215 | A | | 9/1998 | Matthews | |
| 5,913,605 | A | * | 6/1999 | Jusselin et al. | 37/451 |
| 6,018,896 | A | | 2/2000 | Adamic | |
| 6,032,390 | A | | 3/2000 | Bierwith | |
| 6,085,448 | A | * | 7/2000 | Gale et al. | 37/458 |
| 6,092,958 | A | | 7/2000 | Gale | |
| 6,108,950 | A | | 8/2000 | Ruvang et al. | |
| 6,145,224 | A | | 11/2000 | Stickling | |
| 6,311,417 | B1 | * | 11/2001 | Pratt | 37/404 |

FOREIGN PATENT DOCUMENTS

| | | |
|---|---|---|
| CA | 2238644 | 6/1997 |
| CA | 2155012 | 5/1999 |

* cited by examiner

*Primary Examiner*—Victor Batson
(74) *Attorney, Agent, or Firm*—Kohn & Associates, PLLC

(57) ABSTRACT

The present invention provides for an assembly for locking a first workpiece mountable onto a second workpiece. The first workpiece has an opening adapted to allow a locking pin to pass therethrough. The opening is cooperatively disposed with respect to a pin receiving means in the second workpiece when the first workpiece is mounted on the second workpiece. At least one of the first and second workpieces has a recess to receive a pin carrier. The assembly comprises a locking pin adapted to pass through the opening and be received by the pin receiving means when the first workpiece is mounted on the second workpiece; and a pin carrier receivable in the recess. The pin carrier has a pin receiving orifice and is alignable with both the opening and the pin receiving means when the first workpiece is mounted on said second workpiece. The assembly further comprises magnetic means on the locking pin and/or the pin carrier to magnetically attract the locking pin and the pin carrier.

31 Claims, 12 Drawing Sheets

ASSEMBLY FOR FASTENING A GROUND ENGAGING TOOL TO A SUPPORT STRUCTURE

This application is a Continuation-In-Part of U.S. patent application Ser. No. 09/591,764 filed on Jun. 12, 2000 now abandon.

FIELD OF THE INVENTION

The present invention relates to the field of assemblies for fastening ground engaging tools to support structures on powered ground engaging equipment.

BACKGROUND OF THE INVENTION

Many types of excavating equipment utilize replaceable ground engaging tools such as digging teeth. These teeth erode through use and are replaced as needed. For example, depending on the conditions, a given adapter could be re-equipped with from 5 to 30 teeth to maintain a sharp penetrating edge during excavation. The ease of replacement of the teeth is important because it minimizes the amount of wasted throwaway material and also minimizes the down-time of the digging equipment.

The prior art assemblies used to attach a tooth to the adapter consist mainly of two designs, the wedge design and the pin design. In the wedge design, the tooth is joined to the adapter by wedges that are hammered into corresponding slots in the tooth and the adapter. This design has the disadvantage that the wedges would often become dislodged during use of the excavating equipment. To prevent this problem, the wedge was tack-welded in place. However, removal of the wedges was then difficult and time consuming. Removal of teeth on a dragline bucket, for example, required that the bucket be turned on its front end to gain access to the wedges. Furthermore, during removal, the wedges had a tendency to shatter or break causing pieces to jam in the slots and pose a serious safety hazard to workers. Wedge designs are shown, for example, in U.S. Pat. No. 3,256,622.

Pin assemblies are shown in U.S. Pat. No. 2,121,993. This patent discloses a threaded pin and insert assembly for securing a tooth onto the adapter. The threaded insert is placed into the adapter pin opening. The tooth is placed over the adapter. A lock washer is concentrically placed over the pin opening on the tooth. The pin is then screwed into the insert. This assembly has the disadvantage of being cumbersome and complex in design making it difficult to use and increasing the time needed to replace the tooth. As well, the pin has a tendency to loosen from the insert while the tooth is in use. Another pin assembly is shown in U.S. Pat. No. 3,410,010 which discloses a dipper tooth having a detent and key assembly inserted into a passage in the tooth and adapter. This assembly suffers from the drawback that the key would often fall out of the passage during use of the tooth allowing the tooth to fall off the adapter.

Still another locking assembly is shown in U.S. Pat. No. 6,018,896. This patent discloses a locking device for a ground-engaging-tool. The device has a wedge-shaped pin that is held in place by a pin retainer inserted into a cavity in the tool support structure. The wedge-shaped pin holds the tool in position on the support structure by directly engaging the tool and support structure to transmit large tool-removing forces into the support structure. The pin retainer holds the pin in position by engaging the support structure and pin to resist the relatively small pin-removing forces. The pin retainer itself does not transmit or resist large tool-removing forces. That is the job of the pin. Although this coupling device performs well in dry friable material, it is difficult to remove if fluidized material penetrates the coupling device and cements the pin in place.

Thus there is a need for an assembly to lock a removable ground engaging tool to a support structure in such a way that the locking assembly is easy to use, reliable, and economical to manufacture. With the increased awareness of worker safety issues, it is particularly important that such assemblies be easy to install and do not pose a danger to workers.

SUMMARY OF THE INVENTION

The present invention provides for an assembly for locking a first workpiece to a second work piece wherein the first workpiece is mountable to the second workpiece. The assembly comprises a locking assembly and magnetic means for holding the assembly together in locking configuration.

In one embodiment of the present invention, there is provided an assembly for locking a first workpiece mountable onto a second workpiece. The first workpiece has an opening adapted to allow a locking pin to pass therethrough. The opening is cooperatively disposed with respect to a pin receiving means in said second workpiece when the first workpiece is mounted on the second workpiece. At least one of the first and second workpieces has a recess to receive a pin carrier. The assembly comprises a locking pin adapted to pass through the opening and be received by the pin receiving means when the first workpiece is mounted on said second workpiece. The assembly also comprises a pin carrier receivable in the recess. The pin carrier has a pin receiving orifice and is alignable with both the opening and the pin receiving means when the first workpiece is mounted on the second workpiece. The assembly also comprises magnetic means on the locking pin and/or the pin carrier to magnetically attract the locking pin and the pin carrier.

In a further embodiment of the present invention, there is provided an assembly for locking a first workpiece to a second workpiece wherein the first workpiece has a slot in the lower surface of one end opposite to a point and a first opening in its upper surface extending into the slot and the second workpiece has a boss on its upper surface corresponding to the slot in the first workpiece. When the first workpiece is slid onto the second workpiece, the slot engages the boss. The assembly comprises a pin carrier which is slidably receivable into the slot in the first workpiece. It has a pin receiving opening on its upper surface aligning with the first opening in the first workpiece when the pin carrier is inserted into the slot. The assembly also comprises a pin for insertion into the pin receiving opening in the first workpiece and the pin carrier for locking the tooth to the adaptor. The assembly may further comprise magnetic means to magnetically attract the pin, pin carrier, first workpiece, and/or the second workpiece.

In a further embodiment of the present invention, there is provided a method of assembling a first workpiece to a second workpiece comprising the step of mounting a first workpiece on a second workpiece. The first workpiece has an opening being cooperatively disposed with respect to a pin receiving means in the second workpiece when the first workpiece is mounted on the second workpiece. At least one of the first and second workpieces has a recess to receive a pin carrier. The method further comprises the step of inserting a pin carrier into the recess. The pin carrier has a pin receiving orifice which is alignable with both the opening and the pin receiving means when the first workpiece is mounted on the second workpiece. The method further comprises inserting a pin through the opening to be received by the pin receiving means when the first workpiece is mounted on the second workpiece. The method may further comprise the step of magnetically attracting the pin and the pin carrier to maintain the first workpiece on the second workpiece.

BRIEF DESCRIPTION OF THE DRAWINGS

Preferred embodiments of the present invention will now be described and may be better understood when read in conjunction with the drawings in which.

DETAILED DESCRIPTION OF THE INVENTION

The present invention is an assembly and method for locking and unlocking a ground engaging tool to a support structure. The assembly allows a person to easily lock and remove the tool with little chance of injury as compared with prior art methods and assemblies. A preferred embodiment of the assembly suitable for attaching digging teeth to adapters comprises a pin and pin retainer/carrier, and preferably uses magnets to help hold the pin in the retainer during use.

In preferred embodiments of the present invention, the first workpiece comprises a ground engaging tool such as an excavating tooth or lip shroud and the second workpiece comprises a support structure such as an adapter or bucket lip respectively. The first workpiece is slidably mounted onto the second workpiece. While the present invention is described in this art area, it can be seen that the invention is capable of broader application and such applications are applicable herein.

In the present assembly, the purpose of the pin is to resist digging forces that could remove the first workpiece from the second workpiece. It does this by conveying these forces from the first workpiece into the second workpiece either directly or via the pin carrier. The pin can be any desired or suitable shape. Pins in the form of a "T", or inverted "L" or headless (sometimes called "I" pins) are suitable. The pin may additionally comprise removal means, typically a lip or rib for engaging a prying device.

The pin retainer cooperates with the first workpiece to retain the pin in the locked position. The pin carrier further cooperates with the pin and the second workpiece to convey workpiece-removing forces from the pin to the second workpiece.

The first workpiece may comprise a first arm or surface and a second arm or surface adapted to slidably envelop and engage at least part of the second workpiece. In this situation, the pin-receiving means may comprise a second opening running through the second workpiece or, more preferably, may extend further to also comprise a recess or a third opening in the second arm or surface alignable with the opening in the first arm or surface and the second opening in the second workpiece.

Figure 2:
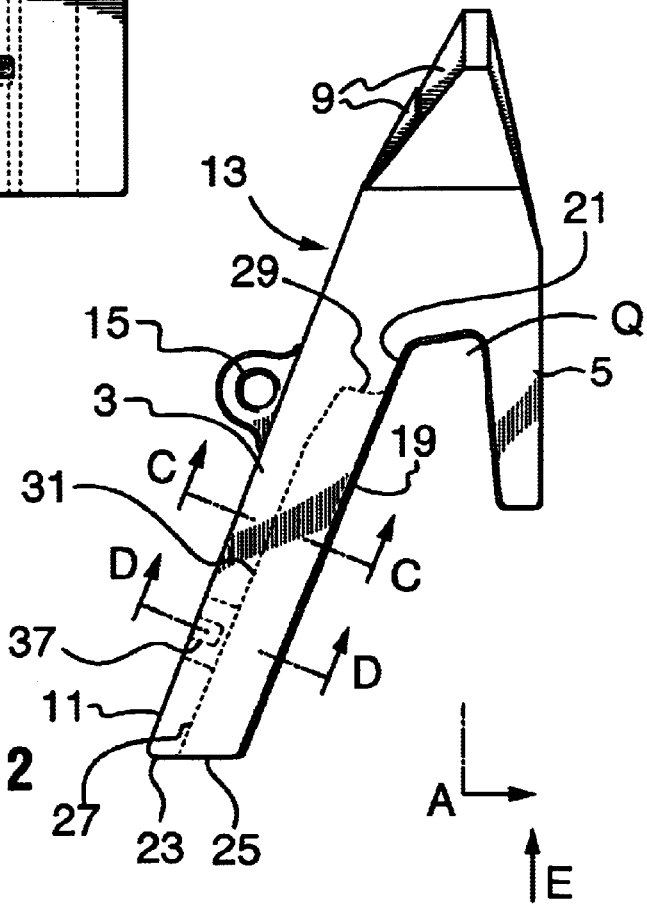
FIG. 2 is a view taken through the centerline B—B of FIG. 1 of the shroud and the lip of the bucket.
Figure 3:
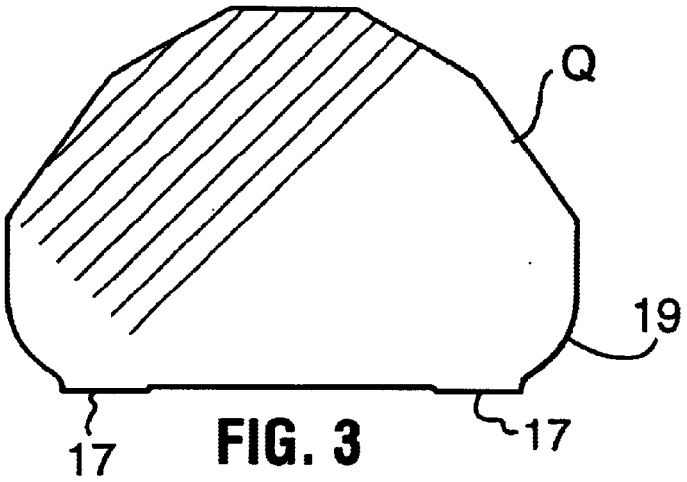
FIG. 3 is a cross sectional view taken at line A—A shown of FIG. 2.
Figure 4:
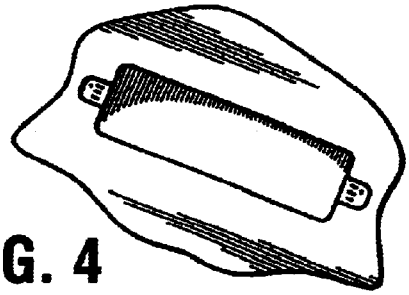
FIG. 4 is a top view of the pin hole opening shown in FIG. 1.
Figure 7:
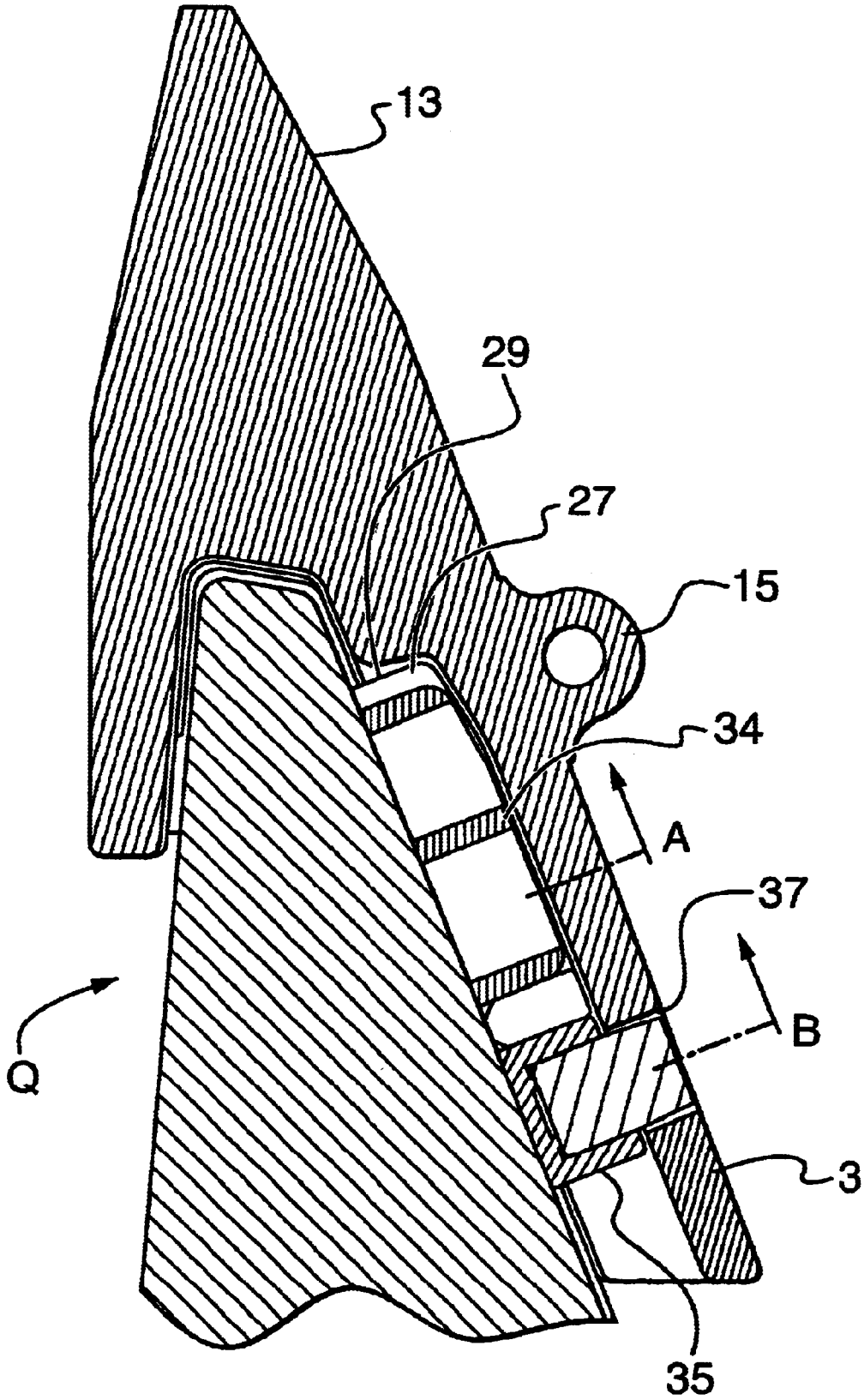
FIG. 7 is a side cross sectional view of the shroud and bucket lip taken at line B—B of FIG. 1 but depicting a conventional boss in the pin carrier slot along with the pin and pin carrier of the present invention.
Figure 8:
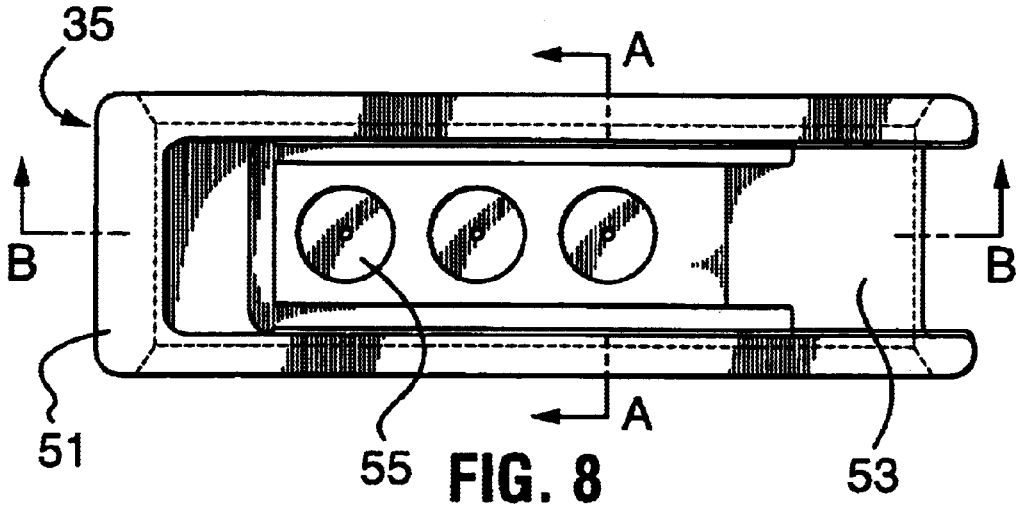
FIG. 8 is a top view of a pin carrier.
Figure 9:
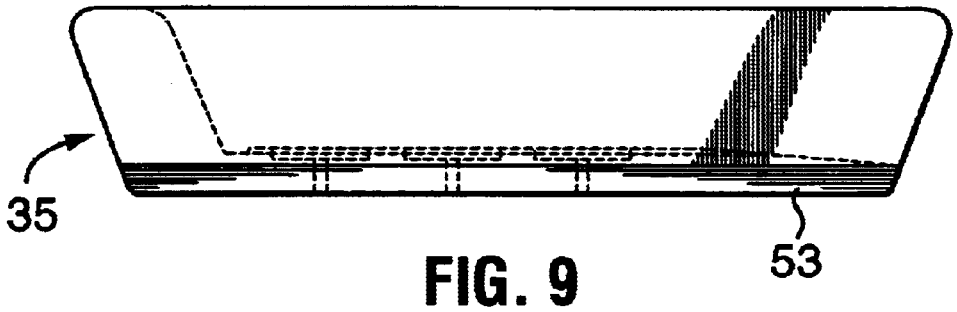
FIG. 9 is a side view of the pin carrier.
Figure 10:
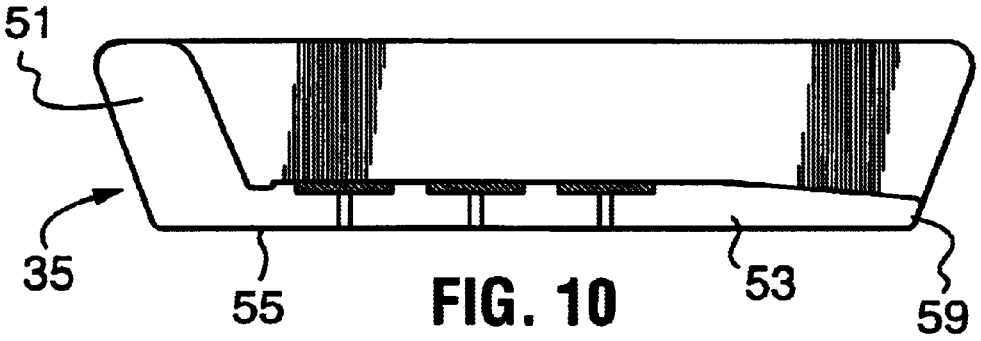
FIG. 10 is a side cross sectional view of the pin carrier taken at line B—B of FIG. 8.
Figure 11:
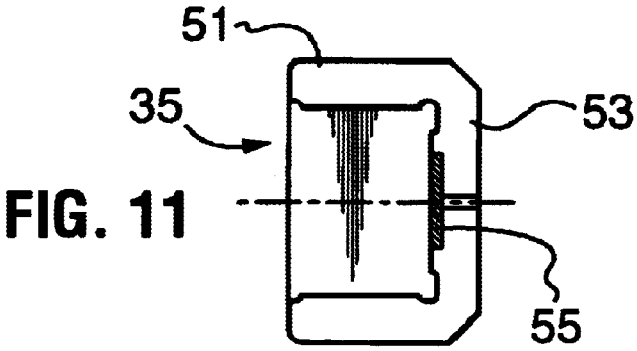
FIG. 11 is an end cross sectional view of the pin carrier taken at line A—A of FIG. 8.
Figure 12:
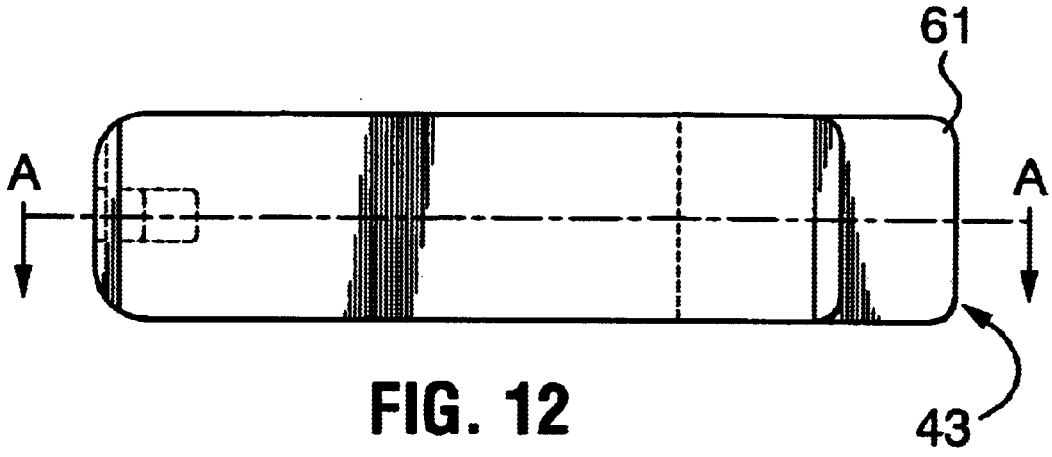
FIG. 12 is a top view of a pin.
Figure 13:
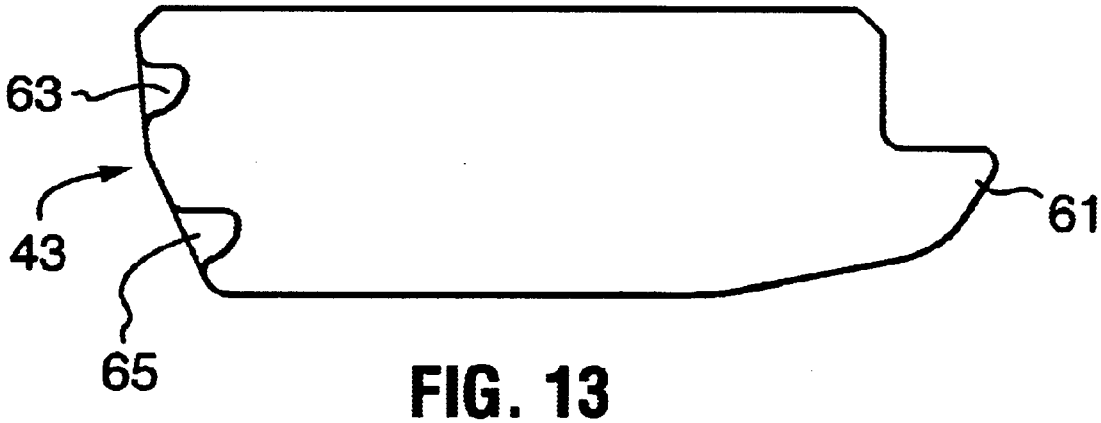
FIG. 13 is a side cross sectional view of the pin taken at line A of FIG. 12.
Figure 14:
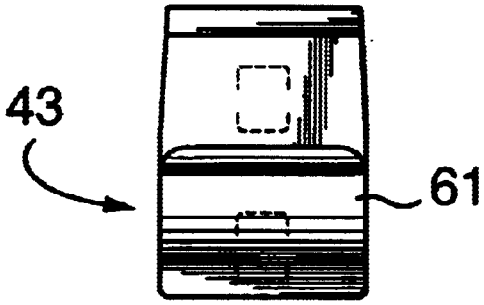
FIG. 14 is an end view of a preferred embodiment of the pin.
Figure 15:
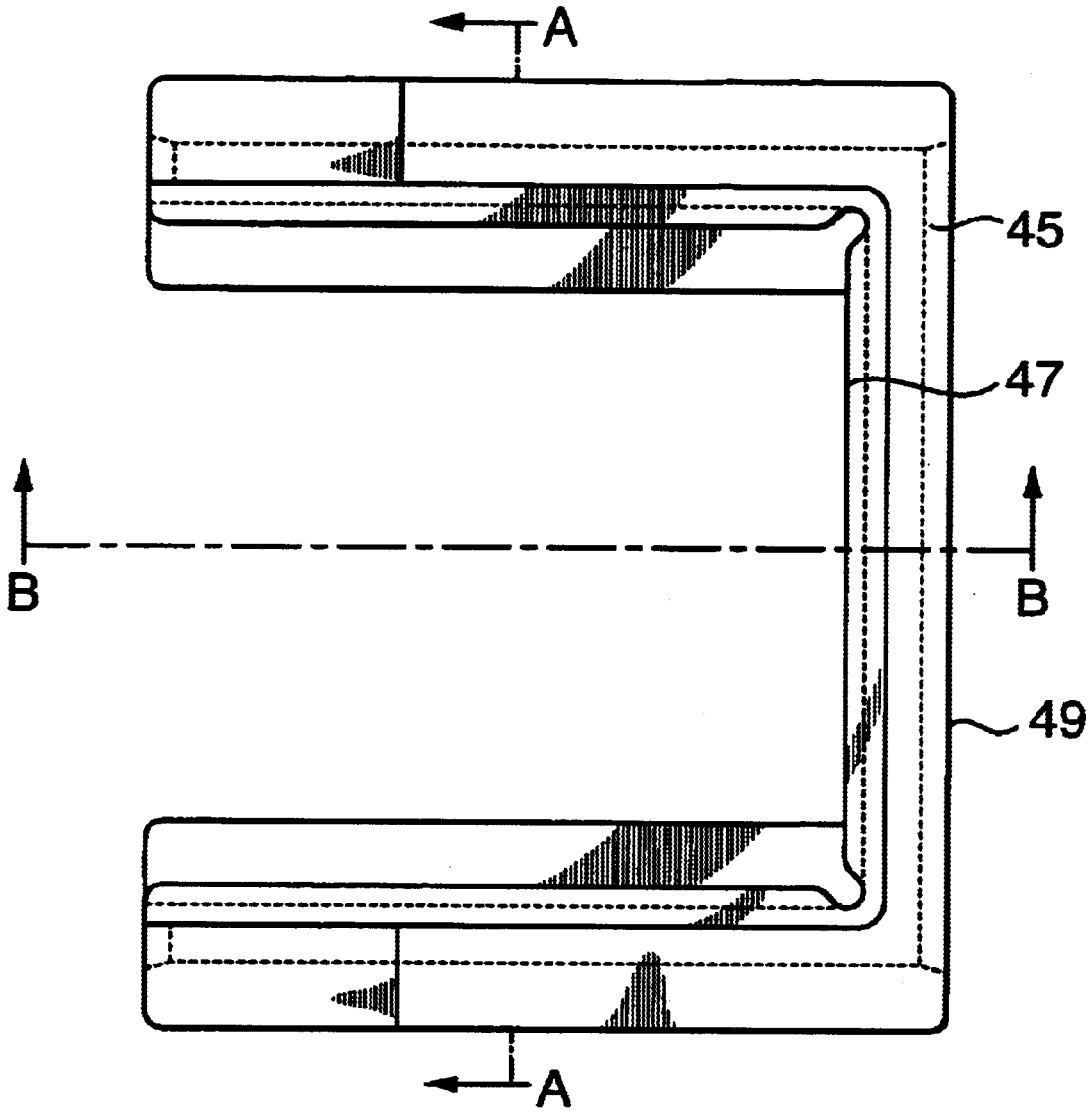
FIG. 15 is a top view of a pin carrier slot adapter.
Figure 16:
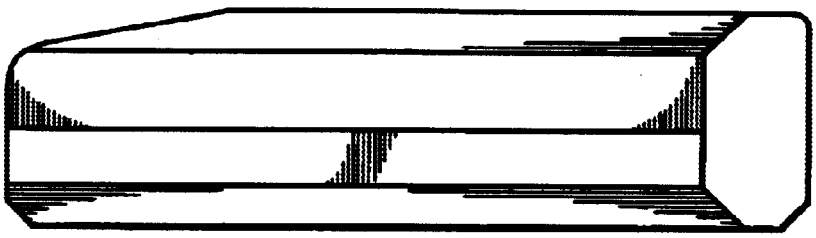
FIG. 16 is a side cross sectional view of the pin carrier slot adapter taken at line B of FIG. 15.
Figure 17:
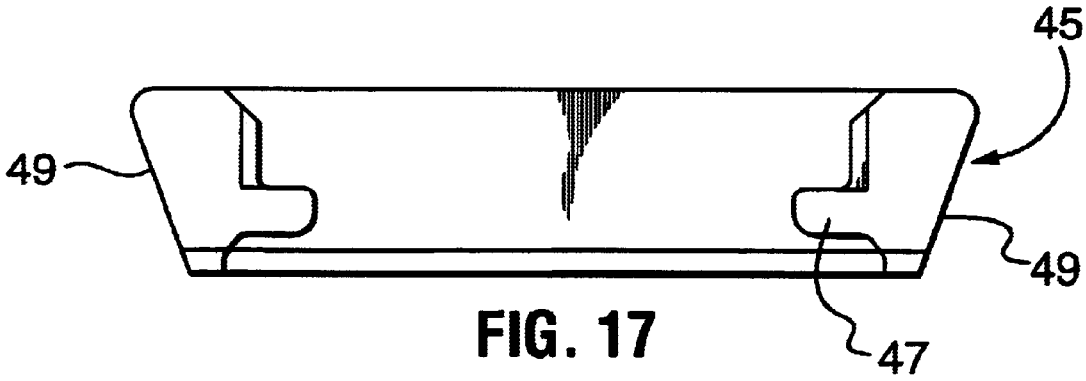
FIG. 17 is a side view of the pin carrier slot adapter taken at line A of FIG. 15.
Figure 18:
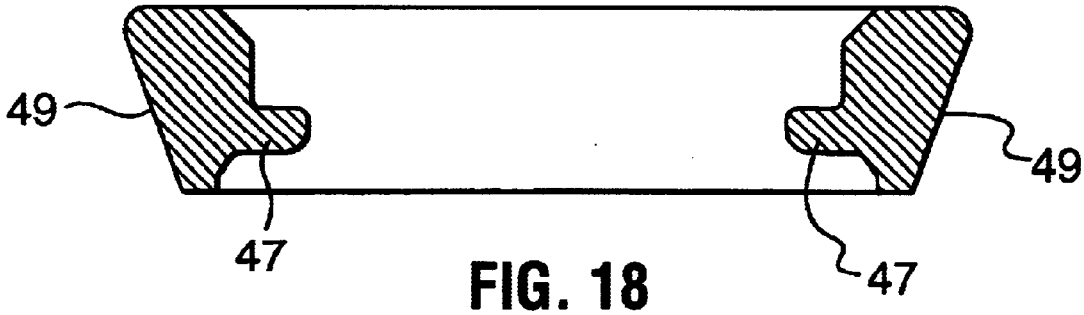
FIG. 18 is a cross sectional view of the pin carrier slot adapter taken at line A of FIG. 15.

With reference to the Figures, a ground engaging tool such as an excavating tooth or lip shroud generally has a triangular shaped cross-section and is formed so as to be received over the working end of a support structure such as an adapter or bucket lip. For example, the bucket lip shown in the side view in FIGS. 2 and 7 illustrates a preferred embodiment of the present invention in the case where the ground engaging tool is a lip shroud and the support structure is a bucket lip.

The tool has a thick section near its tip which comes to a general point P for engaging the ground when placed on the working end of the support structure Q. Extending back from the point P on the ground engaging tool are two arms.

The first arm 3 extends along the upper portion of the tool. The second arm 5 extends along the lower portion of the tool and is shorter and thinner in cross-section than the first arm. Between these arms, there is defined an area for receiving the working end of the support structure Q. When the ground engaging tool is placed on the support structure, the inner surface 21 of the tool engages the outer surface 19 of the support structure. The point P of the tool has hard facing 9 on its surface, as shown in FIG. 1, to extend its life and reduce its rate of wear.

Figure 5:
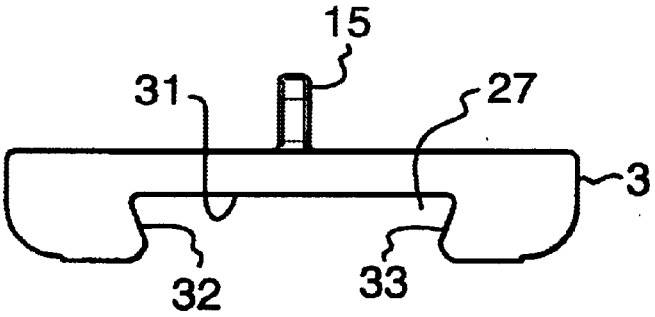
FIG. 5 is a cross sectional view taken at line C of FIG. 2.
Figure 6:
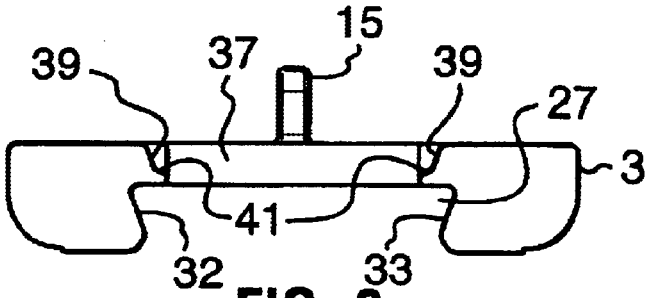
FIG. 6 is a cross sectional view taken at line D of FIG. 2.

The inner surface 21 of the tool may be equipped with fit pads 17 as shown in FIGS. 5 and 6. The working end of the support structure may also have fit pads 17 on its outer surface 19 (shown in FIGS. 19 and 20) positioned under the first arm 3 of the tool for receiving the pin carrier which will be described in more detail below. The fit pads 17 are raised ridges on the tool and its support structure. The pin carrier is positioned between the fit pads when the present invention is assembled.

The outer surface of the lip shroud support structure is fitted with a boss 34 (shown in FIGS. 7 and 20) or may already have a boss extending therefrom. The boss 34 is preferably dovetailed in shape however other embodiments may be used. Particularly where a dovetail configuration is not used, a dovetail boss adapter may be used to ensure a tight fit with the ground engaging tool.

Figure 1:
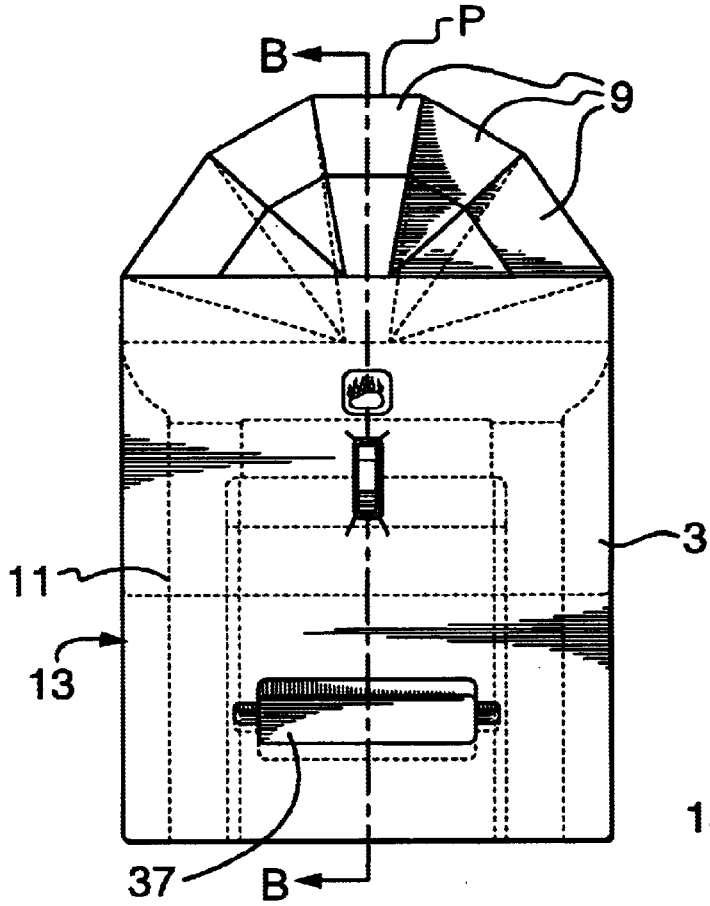
FIG. 1 is a top view of a lip shroud and, in particular, the point of the lip shroud.

The first arm 3 of the ground engaging tool shown in FIGS. 1 and 2 has an outer surface 11, inner surface 21 and an end surface 23. The tool has a standard lifting lug 15 on its outer surface 11. The upper surface 11 of the tool 13 has an elongated opening 37 perpendicular to its longitudinal axis and corresponding to the shape of the pin 43. This opening is adapted to receive the pin 43 when the present invention is fully assembled as will be described in more detail below. This pin opening 37 is shown in more detail in FIGS. 6 and 19. It has end walls 39 that slope inwardly and may end with a ledge 41 extending inwardly into the pin opening 37 at the lower end of the opening.

The end surface 23 of the tool 13 has an opening 25 extending into a pin carrier slot 27. The slot 27 extends through the lower portion of the tool arm 3 along the longitudinal axis of the ground engaging tool. The pin carrier slot 27 is a recess cut into the lower surface of the tool 13 and comprises an inner end wall 29, upper wall 31, and side walls 32, 33.

The sidewalls 32, 33 of the slot 27 are shown in more detail in FIGS. 5, 6, 19 and 20. They are preferably angled inwardly in a dovetail shape to engage the dovetail boss. FIGS. 5 and 6 show an angle of approximately 20 degrees, however, any angle and shape may be used which allows the slot to engage the boss. The tool is slid over the support structure so that the slot 27 of the tool slideably engages the boss 34. When the tool is slid over the support structure, the boss engages the inner end wall 29 of the tool 13. While the boss 34 is preferably a dovetail shaped boss, other configurations may be used. Dovetail adapters may be fitted around the boss in order to achieve a dovetail configuration or other configurations known in the art may be used with which the ground-engaging tool may engage the boss. One example is shown in FIGS. 15–18. These Figures depict a dovetail adapter 45 that has an inner ridge 47 for engaging a non-dovetail boss. The outer walls 49 of the dovetail adapter 45 are shaped so as to correspond to the inner sidewalls 32, 33 of the pin carrier slot 27 for engagement and retention with the slot.

Figure 28:
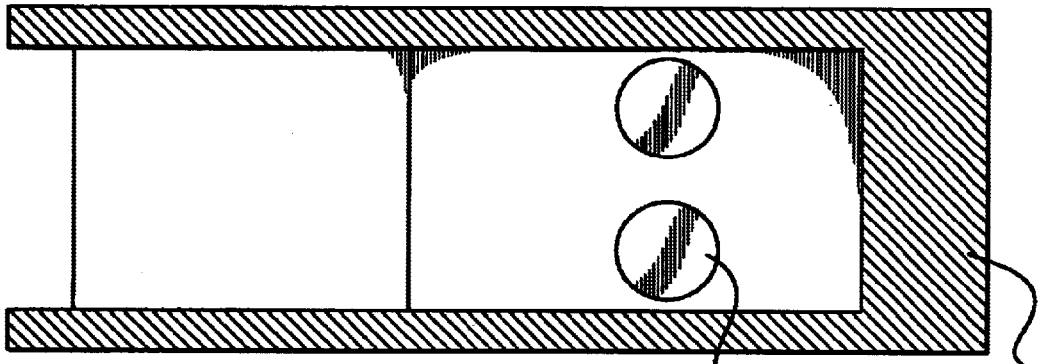
FIG. 28 is a top conceptual view of a pin carrier of a further embodiment of the present invention.
Figure 29:
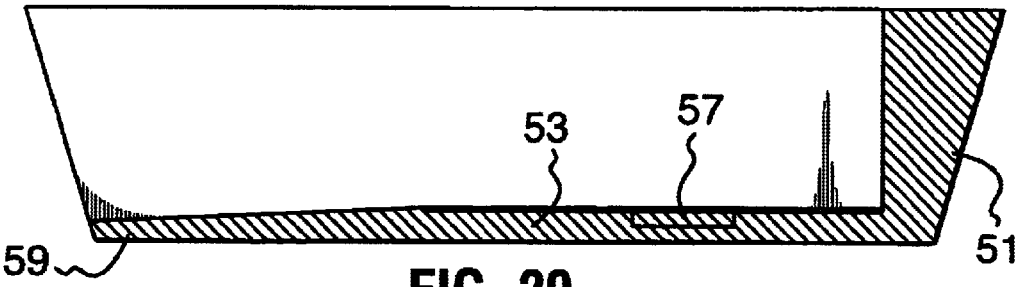
FIG. 29 is a side cross sectional view of the pin carrier of FIG. 28.

The assembly of the present invention includes a pin carrier 35 shown in more detail in FIGS. 8–11, 24, 25, 28 and 29. The pin carrier 35 is elongated having an end wall 51 extending upwardly and a generally flat elongated lower section 53 extending from the lower end of the end wall 51. The outer portion of the lower section 53 may extend at a downward angle providing a tapered end 59 to the pin carrier 35. The upper surface of the lower section 53 contains receptacles 55 for magnets 57. These receptacles are shown as three round areas in FIGS. 8 and 10; however, other arrangements of magnets may be used. An example is shown in FIGS. 28 and 29.

The pin carrier 35 may be slideably inserted into the pin carrier slot 27 through the opening 25 in the end surface 23 of the tool 13. It is fully inserted when the pin carrier is in alignment with the pin opening 37 in the tool. The boss 34 extends from the rear wall of the tool to the pin opening. The rear surface of the boss is positioned forward of the pin opening towards the point of the tool so that the pin carrier may be inserted into the slot and positioned under the pin opening and against the boss. The pin opening 37 in the upper surface of the tool 13 and the inserted pin carrier define a pin-receiving chamber.

Figure 19:
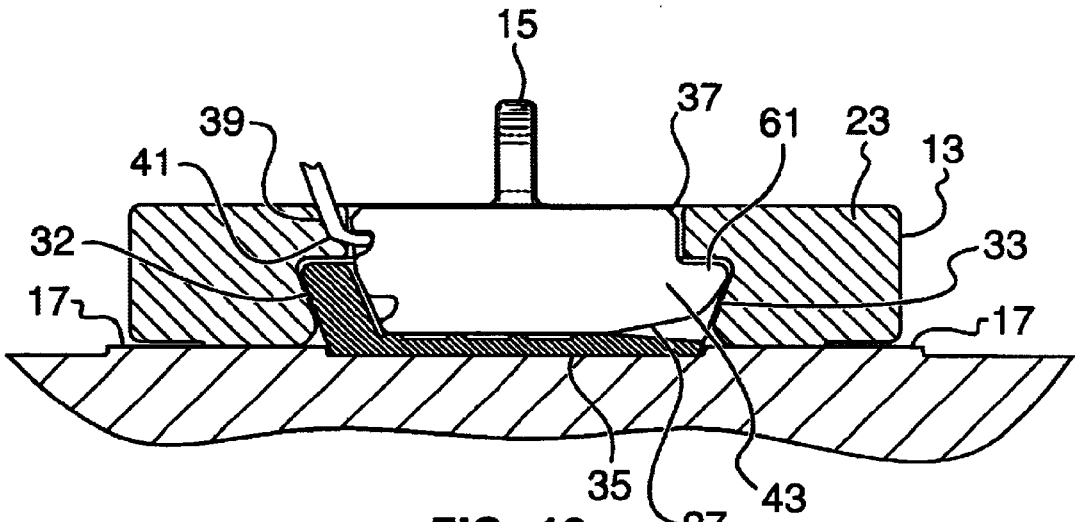
FIG. 19 is a side cross sectional view taken at line B of FIG. 7.
Figure 20:
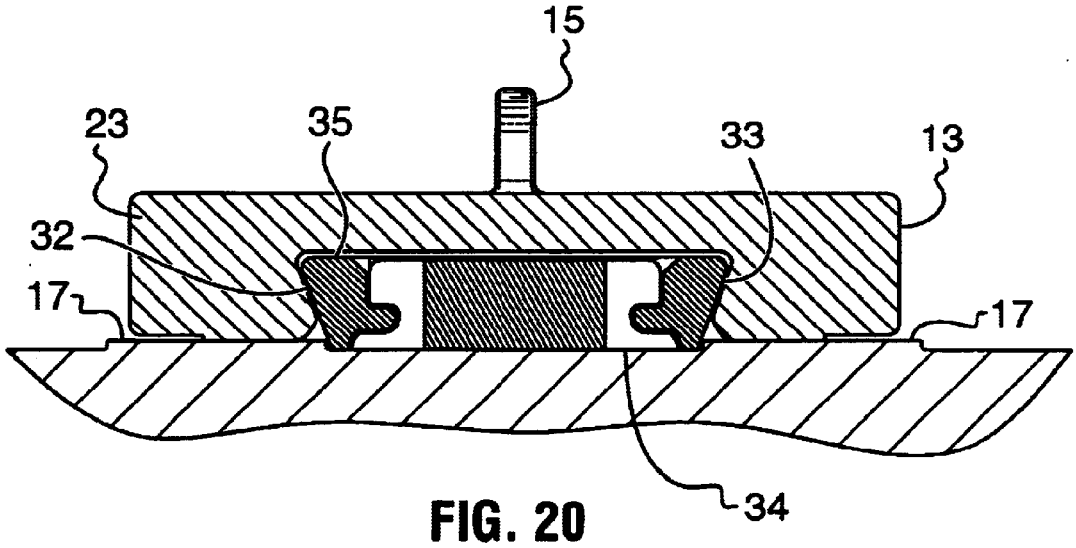
FIG. 20 is a side cross sectional view taken at line A of FIG. 7.
Figure 21:
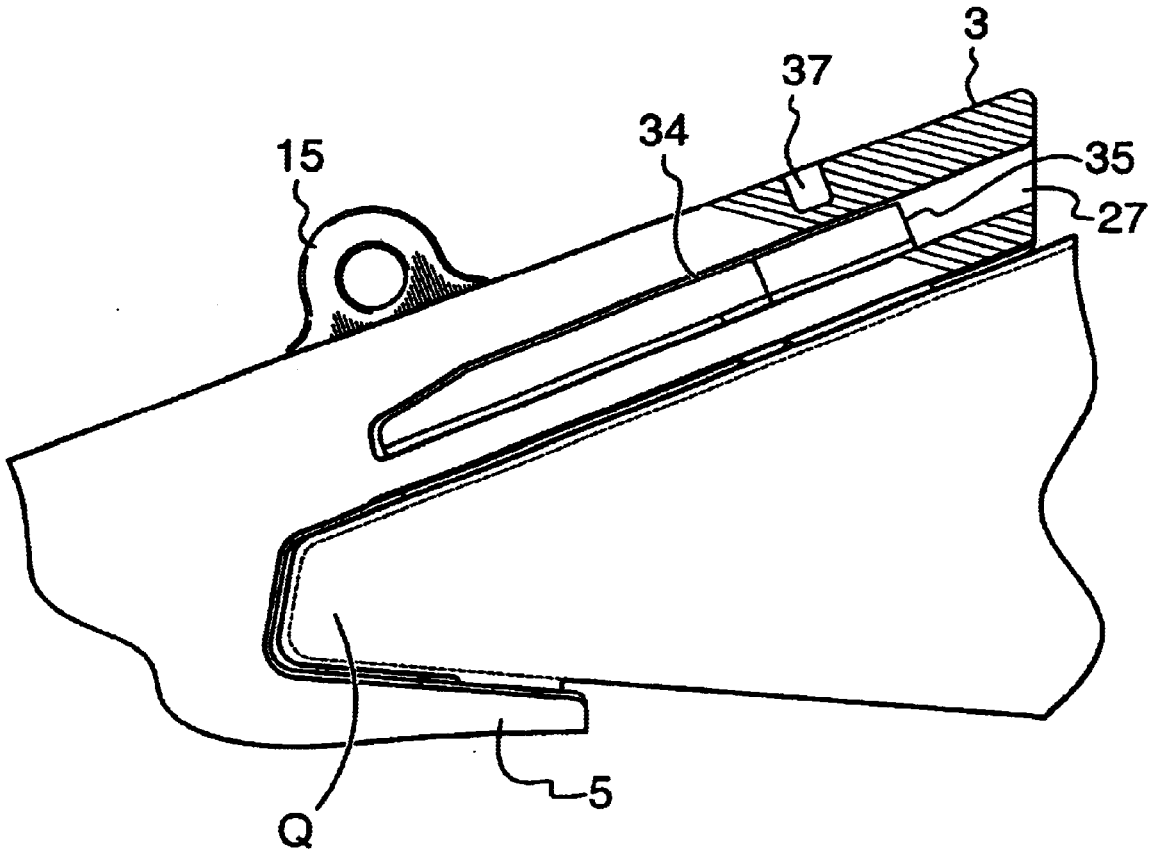
FIG. 21 is a side cross sectional view taken at line C of FIG. 1.
Figure 22:
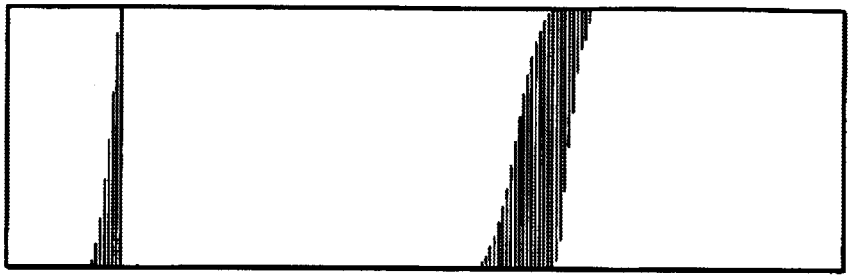
FIG. 22 is a top conceptual view of a preferred embodiment of a pin of the present invention.
Figure 23:
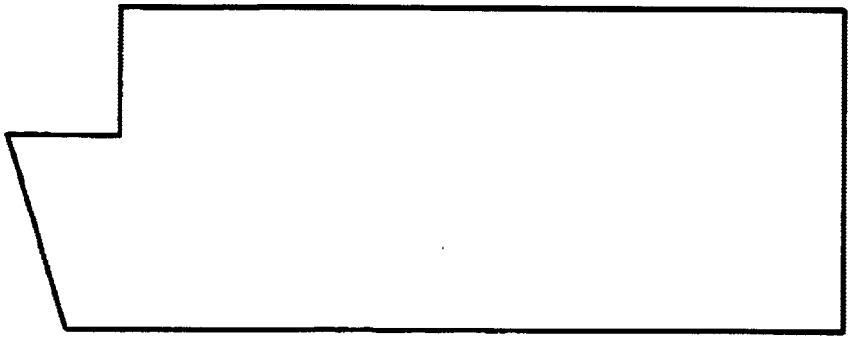
FIG. 23 is a side cross sectional view of the pin of FIG. 22.
Figure 24:
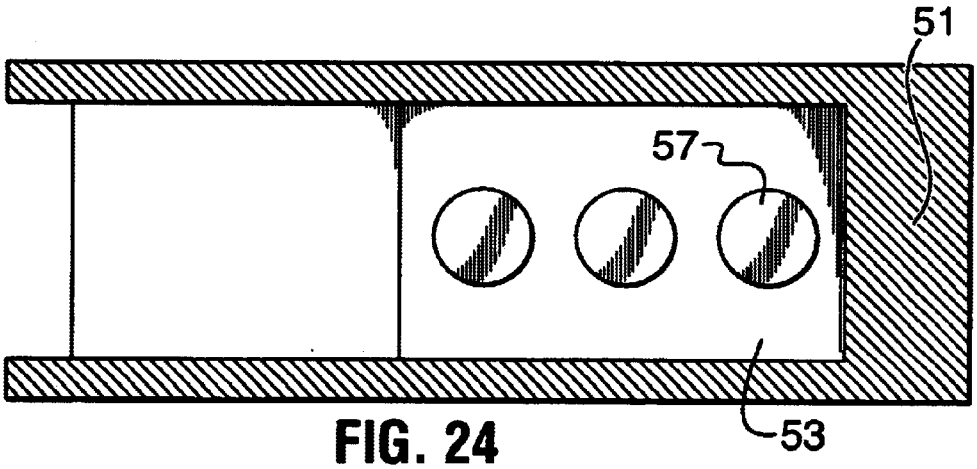
FIG. 24 is a top conceptual view of a pin carrier of the present invention.
Figure 25:
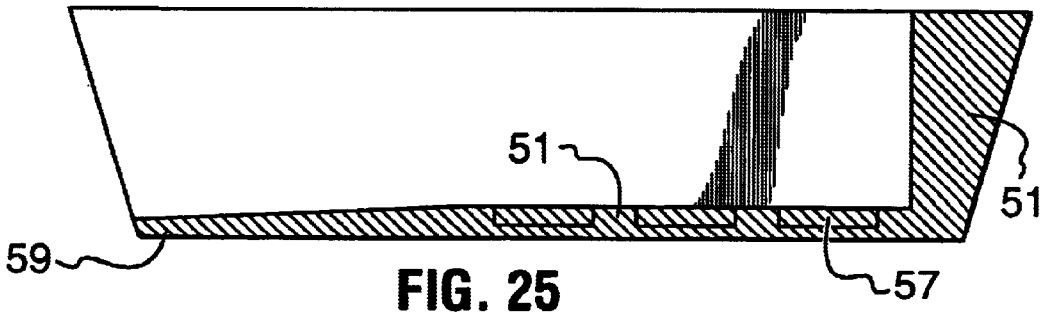
FIG. 25 is a side cross section view of the pin carrier of FIG. 24.

The pin 43 is shown in FIGS. 12–14, 22, 23, 26 and 27. It is an elongated piece having one end with a lip portion 61 and the opposing end with openings 63, 65 therein. The pin 43 may be inserted through the pin opening 37 in the tool 13 into the pin-receiving chamber. A portion of the pin 43 remains in the pin opening 37 in the tool 13 and may extend therefrom. The lip 61 at one end of the pin 43 engages the lower surface of the tool 13 as shown in FIG. 19. The lip 61 helps to maintain the pin 43 in the pin opening 37. The pin 43 is made of a material that will be drawn to the magnets and preferably is steel. The magnets 57 are arranged and aligned so as to attract the pin 43 to the pin carrier 35, thereby retaining it in the pin-receiving chamber. The magnetic attraction of the pin 43 to the pin carrier 35 is sufficient to maintain the pin 43 in the pin opening 37 in the tool 13 and thereby maintain the ground engaging tool on the working end of its support structure during use.

To remove the pin 43 from the pin carrier 35, a pry bar or other similar tool may be used. One end of the pry bar is inserted into the upper opening 63 in the end of the pin 43 by insertion down the angled wall of the pin opening 37 in the tool as is shown in FIG. 19. The protrusion at the lower end of the opening and the angled wall provide leverage and support for the pry bar. The pry bar is forced into the opening 63 and is used to leverage the pin 43 out of the pin carrier 35. If necessary, the pin may be partially removed and the pry bar inserted into the second lower opening 65 in the pin to further leverage it out of the pin opening in the tool. As the pin is lifted and moved away from the pin carrier and the magnets, the magnetic force on the pin will decrease thereby releasing the pin. Once the pin is removed, the pin carrier and the ground engaging tool may be removed from the end of the support structure and the tool replaced.

Figure 26:
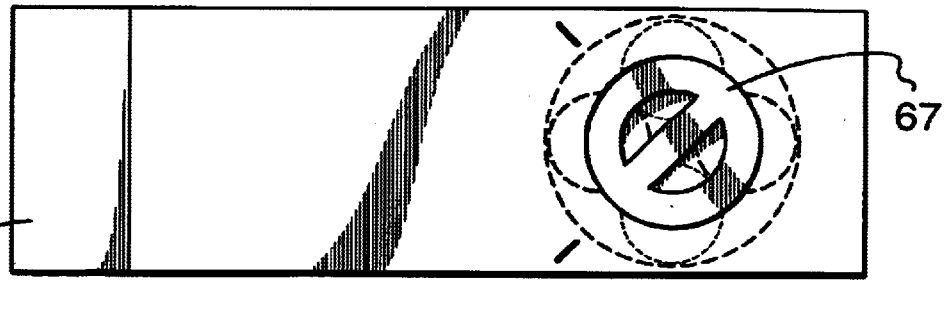
FIG. 26 is a top conceptual view of the pin of a further embodiment of the present invention.
Figure 27:
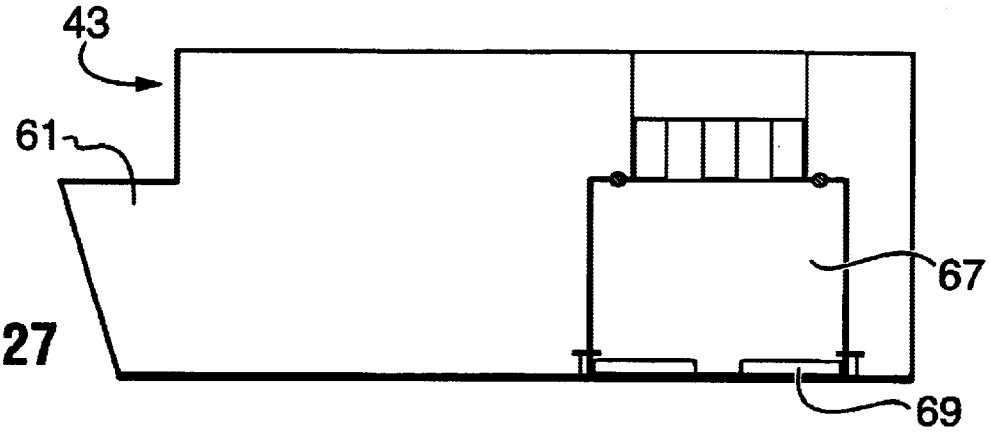
FIG. 27 is a side cross sectional view of the pin of FIG. 26.

An alternative embodiment of the pin is shown in FIGS. 26 and 27. These Figures shown a pin cylinder 67 near one end of the pin. It may be manually rotated 90 degrees about its center axis. It contains a plurality of magnets 69 on its lower surface. The pin carrier contains a matching plurality of magnets on its upper surface. The poles of these magnets are arranged so that with the cylinder 67 rotated to the lock position, the pole alignments for the pin and carrier magnets are such that the pin and carrier are strongly attracted together thereby holding the pin firmly in place. When the cylinder is rotated 90 degrees to the unlocked position, the alignment of poles between the pin and carrier magnets reverses and the magnetic forces become repulsive. The pin is thus easily removed from the opening by hand.

Figure 30:
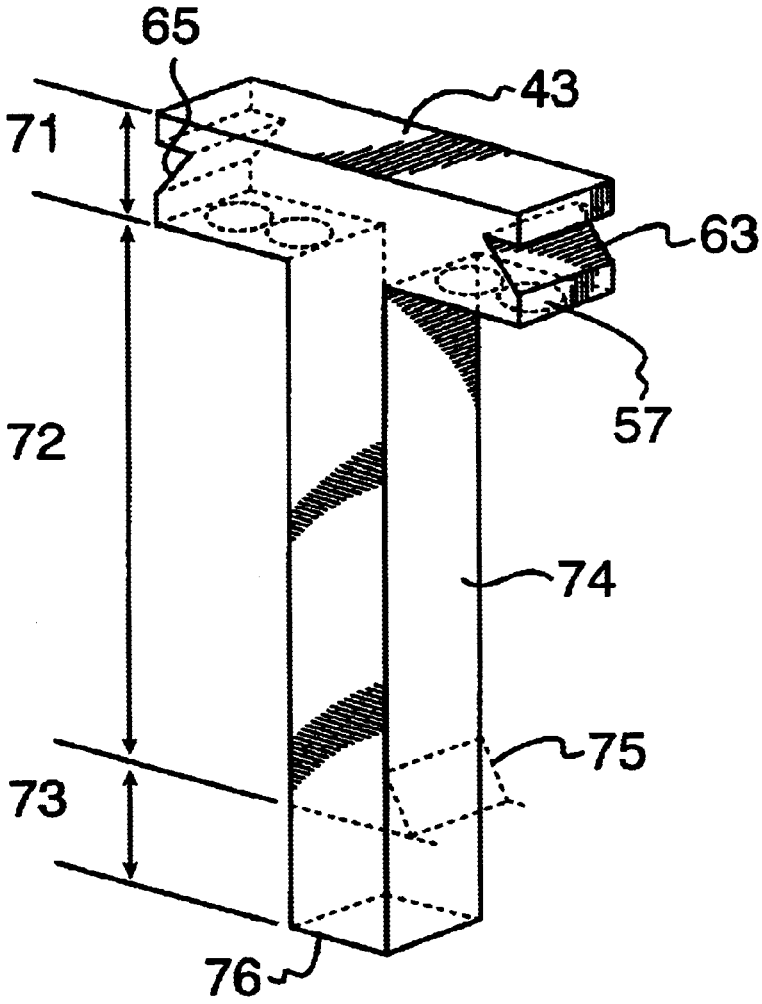
FIG. 30 is a perspective view of a pin in a further embodiment of the invention.
Figure 31:
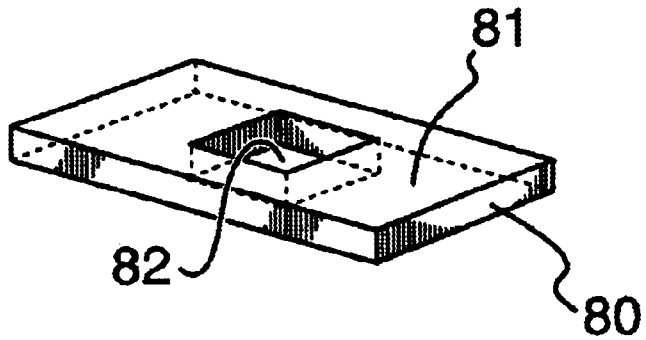
FIG. 31 is a perspective view of a pin retainer for use with the pin of FIG. 30.

A further embodiment of the pin is shown in FIG. 30 and a corresponding pin retainer is shown in FIG. 31. This type of pin is designed to be inserted through a transverse pin opening 37 in upper arm 3. The shape of pin 43 matches the shape of transverse pin opening 37. The pin carries pry grooves 63, 65 at opposed side ends of the pin and comprises magnets 57 inserted in a machined under-surface of the pin. The pin also carries a leg 74 large enough to fit through a corresponding orifice through bucket lip Q and through lower arm 5 so that the bottom 76 of leg 74 is flush with a bottom surface of lower arm 5. The orifice through bucket lip Q is optionally tapered at the bottom to provide a debris reservoir. This option is shown in broken lines as 75. When pin 43 is in place, length 71 sits in upper arm 3, length 72 sits in bucket lip Q and length 73 sits in lower arm 5. In alternative embodiments leg 74 may only extend (a) part of the way into lower arm 5, (b) only through bucket lip Q but not through lower arm 5, or (c) only part way through bucket lip Q. In further alternative embodiments the pin and/or leg may be wholly or partly cylindrical.

FIG. 31 illustrates a pin retainer 80 for use with the pin 43 of FIG. 30. The pin retainer may fit a matching recess in the upper surface of bucket lip Q and is held in position by inner surface 21 of upper arm 3. Magnets 57 grip the flat upper surface 81 of the pin retainer. Leg 74 passes through orifice 82 of the pin retainer. Typically the pin retainer is cut from flat steel plate and the matching recess in the upper surface of bucket lip Q is formed during casting. In alternative embodiments the matching recess is located in the inner surface 21 of upper arm 3 and the pin retainer is held in position within the recess by magnetic or resilient means along one or more sides or is simply supported from below by the upper surface of bucket lip Q.

To install the pin of FIG. 30 the operator first places the pin retainer 80 into the matching bucket lip recess, the lip shroud is then slid over the bucket lip and transverse pin opening 37 aligned with the corresponding orifice through bucket lip Q before the pin is dropped in so that the magnets 57 engage the upper surface of the pin retainer.

To remove the pin of FIG. 30, the pin 43 is pried loose with a pry bar placed in at least one of openings 63 and 65. The end of the pin above 63 or 65 may be recessed slightly or alternatively the transverse pin opening 37 may be correspondingly recessed slightly to allow access for the pry bar to openings 63 and 65.

The pin of FIG. 30 permits a simpler design of lip shroud and bucket lip in that leg 74 functionally effectively replaces boss 34 and pin carrier slot 27. The pin and related pin retainer design of FIGS. 30 and 31 is therefore also suitable for locking excavating teeth to adapters that are not equipped with bosses and boss-receiving slots. Alternative embodiments to the "T" pin design illustrated in FIG. 30 include an inverted "L" design (one top arm of the "T" has been deleted), or an "I" design comprising effectively only leg 74 with a magnet or magnets on a side face of the leg or inset into a matching part of upper arm 3, bucket lip Q or lower arm 5.

It can be seen that the utility of this type of reversible coupling extends beyond ground engaging tools and their support structures and is of utility anywhere that firm, dependable but readily reversible coupling is required.

Since the pin may be easily removed by a worker with a pry bar, it poses little danger to workers. There is less chance of injury to workers in removing and replacing ground-engaging tools. As well, standard assemblies to attach teeth to adapters often fail during use. With the present invention, the magnetic attraction of the pin to the pin carrier is unlikely to fail causing injury to nearby workers.

The above-described embodiments of the present invention are meant to be illustrative of preferred embodiments and are not intended to limit the scope of the present invention. Variations of the invention will be readily apparent to persons skilled in the art and may be made without departing from the spirit or scope of the invention. These variations are intended to be within the scope of the present invention. The only limitations to the scope of the present invention are set out in the following appended claims.

What is claimed is:

1. An assembly for locking a first workpiece mountable on to a second workpiece, wherein said first workpiece has an opening adapted to allow a locking pin to pass therethrough, said opening being cooperatively disposed with respect to a pin receiving means in said second workpiece when said first workpiece is mounted on said second workpiece, at least one of said first and second workpieces having a recess to receive a pin carrier, said assembly comprising:

a) a locking pin adapted to pass through said opening and be received by said pin receiving means when said first workpiece is mounted on said second workpiece;

b) a pin carrier receivable in said recess, said pin carrier having a pin receiving orifice and alignable with both said opening and said pin receiving means when said first workpiece is mounted on said second workpiece; and c) magnetic means on said locking pin and/or said pin carrier to magnetically attract the locking pin and the pin carrier.

2. An assembly according to claim 1 wherein said first workpiece is slidably mountable on said second workpiece.

3. An assembly according to claim 2 wherein, when said pin carrier is receivable in said first workpiece, said recess comprises a slot to allow slidable mounting of said first workpiece on to said second workpiece with said pin carrier.

4. An assembly according to claim 1 wherein said first workpiece comprises an excavating tooth and said second workpiece comprises an adapter, or said first workpiece comprises a lip shroud and second workpiece comprises a bucket lip.

5. An assembly according to claim 4 wherein the magnetic means is on the locking pin.

6. An assembly according to claim 4 wherein the magnetic means is on the pin carrier.

7. An assembly according to claim 1 wherein the magnetic means magnetically attracts the locking pin, the first workpiece and the second workpiece.

8. An assembly according to claim 7 wherein the magnetic means is on the locking pin.

9. An assembly according to claim 7 wherein the magnetic means is on at least one of the first workpiece and the second workpiece.

10. An assembly according to claim 1 wherein said locking pin has a "T" shape profile.

11. An assembly according to claim 1 wherein said locking pin has an inverted "L" shape profile.

12. An assembly according to claim 7 wherein said locking pin is headless and said magnetic means is located on the locking pin or the pin carrier or both of the first workpiece and the second workpiece.

13. An assembly according to claim 1 wherein said pin receiving means comprises a second opening running through said second workpiece.

14. An assembly according to claim 1 wherein said first workpiece comprises a first arm and a second arm, said first arm and said second arm adapted to slidably envelop at least part of said second workpiece, said opening in said first workpiece being in said first arm, said pin receiving means comprising a second opening running through said second workpiece.

15. An assembly according to claim 14 wherein said pin receiving means additionally comprises a recess in the second arm of said first workpiece, said recess alignable with said opening in said first workpiece and said second opening in said second workpiece when said first workpiece is mounted on said second workpiece.

16. An assembly according to claim 15 wherein said pin receiving means additionally comprises a third opening in the second arm of said first workpiece alignable with said opening in said first workpiece and said second opening in said second workpiece when said first workpiece is mounted on said second workpiece.

17. An assembly according to claim 1 wherein said locking pin additionally comprises removal engagement means.

18. The assembly of claim 1 wherein the locking pin comprises an elongated pin having a cylindrical portion including magnets on one end thereof and rotatable from a first position where the magnets on the locking pin co-operate with magnets on the pin carrier to retain the locking pin in the pin carrier by magnetic attraction and a second position wherein the magnets align similar poles thereby allowing the locking pin to be removed from the pin carrier.

19. An assembly for locking a first workpiece to a second workpiece wherein the first workpiece has a slot in the lower surface of one end opposite to a point and a first opening in its upper surface extending into the slot; the second workpiece having a boss on its upper surface corresponding to the slot in the first workpiece wherein when the first workpiece is slid onto the second workpiece, the slot engages the boss, the assembly comprising:

a) a pin carrier for being slidably receivable into the slot in the first workpiece, and having a pin receiving opening on its upper surface aligning with the first opening in the first workpiece when the pin carrier is inserted into the slot;

b) a pin for insertion into the pin receiving opening in the first workpiece and the pin carrier for locking the tooth to the adapter; and c) magnetic means to magnetically attract said pin carrier and said pin.

20. The assembly of claim 19 wherein the magnetic means is positioned on the pin carrier.

21. The assembly of claim 19 wherein the magnetic means is positioned on the pin.

22. The assembly of claim 19 wherein the magnetic means magnetically attracts the pin, first workpiece, and second workpiece.

23. The assembly of claim 19 further comprising an adapter for insertion between the slot and the boss for retaining the slot on the boss.

24. The assembly of claim 19 wherein the pin includes a lip at one end for engaging the first workpiece and an opening at another position for engagement with a removal means for removing the pin.

25. The assembly of claim 19 wherein the pin comprises an elongated pin having a cylindrical portion including magnets on one end thereof and rotatable from a first position where the magnets on the pin co-operate with the magnets on the pin carrier to retain the pin in the pin carrier by magnetic attraction and a second position wherein the magnets align similar poles thereby allowing the pin to be removed from the pin carrier.

26. A method of assembling a first workpiece to a second workpiece comprising the steps of:

a) mounting a first workpiece on a second workpiece, the first workpiece having an opening being cooperatively disposed with respect to a pin receiving means in the second workpiece when the first workpiece is mounted on the second workpiece, at least one of the first and second workpieces having a recess to receive a pin carrier;

b) inserting a pin carrier into the recess, the pin carrier having a pin receiving orifice and alignable with both said opening and the pin receiving means when the first workpiece is mounted on the second workpiece;

c) inserting a pin through the opening to be received by the pin receiving means when the first workpiece is mounted on the second workpiece; and d) magnetically attracting the pin and the pin carrier to maintain the first workpiece on the second workpiece.

27. The method of claim 26 wherein said inserting step includes inserting the pin carrier into the recess prior to mounting the first workpiece on to the second workpiece.

28. The method of claim 26 further including removing the pin from the pin carrier by rearrangement of magnets to reduce, eliminate, or reverse the magnetic attraction.

29. The method of claim 26 further including removing the pin from the pin carrier by prying.

30. The method of claim 26 wherein said first workpiece is an excavating tooth and said second workpiece is an adapter.

31. The method of claim 26 wherein said first workpiece is a lip shroud and said second workpiece is a bucket lip.

* * * * *